US005679877A

United States Patent [19]

Erilli et al.

[11] Patent Number: 5,679,877

[45] Date of Patent: Oct. 21, 1997

[54] THICKENED LIQUID CLEANING COMPOSITION CONTAINING AN ABRASIVE

[75] Inventors: Rita Erilli, Liege; Chantal Gallant, Cheratte; Viviane Tack, Soumagne, all of Belgium

[73] Assignee: Colgate-Palmolive Co., Piscataway, N.J.

[21] Appl. No.: 664,371

[22] Filed: Jun. 14, 1996

[51] Int. Cl.[6] ..... C11D 3/06; C11D 3/08

[52] U.S. Cl. ..... 510/218; 510/235; 510/236; 510/424; 510/426; 510/427; 510/428

[58] Field of Search ..... 510/218, 235, 510/236, 424, 426, 427, 428

[56] References Cited

U.S. PATENT DOCUMENTS

| | | | |
|---|---|---|---|
| 3,658,985 | 4/1972 | Olson, Jr. et al. | 424/70 |
| 3,769,398 | 10/1973 | Hewitt | 424/70 |
| 3,935,129 | 1/1976 | Jabalee | 252/525 |
| 3,970,596 | 7/1976 | Klisch et al. | 252/546 |
| 3,979,314 | 9/1976 | Child | 252/140 |
| 4,013,787 | 3/1977 | Varierberghe | 424/70 |
| 4,129,515 | 12/1978 | Foster | 252/531 |
| 4,154,706 | 5/1979 | Kenkare et al. | 252/547 |
| 4,181,633 | 1/1980 | Coludney et al. | 252/525 |
| 4,224,195 | 9/1980 | Kawasaki et al. | 252/546 |
| 4,259,204 | 3/1981 | Homme | 252/174.16 |
| 4,329,334 | 5/1982 | Su et al. | 424/70 |
| 4,329,335 | 5/1982 | Su et al. | 424/70 |
| 4,329,336 | 5/1982 | Su et al. | 424/70 |
| 4,338,204 | 7/1982 | Spanelini et al. | 252/8.25 |
| 4,388,204 | 6/1983 | Dimond | 252/98 |
| 4,450,091 | 5/1984 | Schmolka et al. | 252/174.21 |
| 4,457,322 | 7/1984 | Rubin et al. | 134/2 |
| 4,457,856 | 7/1984 | Mitchell | 252/166 |
| 4,528,039 | 7/1985 | Rubin et al. | 134/2 |
| 4,537,604 | 8/1985 | Dawson | 51/298 |
| 4,595,526 | 6/1986 | Lai | 252/545 |
| 4,704,222 | 11/1987 | Smith | 252/106 |
| 4,842,757 | 6/1989 | Reboa et al. | 252/76 |
| 4,844,821 | 7/1989 | Mermelstein et al. | 252/8.7 |
| 5,279,755 | 1/1994 | Choy et al. | 252/76 |
| 5,346,641 | 9/1994 | Argo et al. | 252/163 |
| 5,470,499 | 11/1995 | Choy et al. | 252/99 |
| 5,529,711 | 6/1996 | Brodbeck et al. | 252/102 |

*Primary Examiner*—Paul Lieberman
*Assistant Examiner*—Necholus Ogden
*Attorney, Agent, or Firm*—Richard E. Nanfeldt

[57] ABSTRACT

A thickened liquid cleaning composition with desirable cleaning properties and mildness to the human skin comprising a paraffin sulfonate, an ethoxylated alkyl ether sulfate, optionally, a zwitterionic, a clay thickener, optionally, an abrasive and an essential oil and water.

9 Claims, No Drawings

THICKENED LIQUID CLEANING COMPOSITION CONTAINING AN ABRASIVE

FIELD OF THE INVENTION

The present invention relates to novel thickened liquid cleaning composition containing an abrasive with high foaming properties, containing at least one anionic surfactant as the major active ingredient optionally, a zwitterionic betaine surfactant, a Laponite day thickener and water.

BACKGROUND OF THE INVENTION

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient. The specific class of anionic utilized in this patent is the very same group of anionic detergents expressly excluded in present invention in order to eliminate the alkanol ethoxylate sulfation process and the potential dioxane toxicity problem. Furthermore, this patent finds heavily foaming detergents undesirable for the purpose of washing socks.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

SUMMARY OF THE INVENTION

It has now been found that a thickened liquid cleaning composition can be formulated with an anionic surfactant as the major active ingredient which has desirable cleaning properties and mildness to the human skin.

Another object of this invention is to provide a thickened novel anionic based, liquid cleaning composition containing a major amount of anionic surfactant optionally, a zwitterionic betaine surfactant, optionally, an abrasive and a clay thickener, wherein the composition does not contain any formate, HETDA, fatty acids, builder salts, polymeric thickeners, alkyl glycine surfactant, cyclic imidinium surfactant, N-polyvinyl pyrrolidone homopolymer or copolymer of N-polyvinyl pyrrolidone and dimethylaminoethyl methacrylate.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

The present invention relates to a thickened liquid cleaning composition containing at least one anionic surfactant selected from the group consisting of water soluble salts of $C_8$–$C_{18}$ alkyl sulfates, $C_8$–$C_{16}$ benzene sulfonates, $C_{10}$–$C_{20}$ paraffin sulfonates, alpha $C_{10}$–$C_{24}$ olefin sulfonates, $C_8$–$C_{18}$ alkyl sulfoacetates, $C_8$–$C_{18}$ alkyl sulfosuccinate esters, $C_8$–$C_{18}$ acyl isethionates and $C_8$–$C_{18}$ acyl taurates; and optionally, a water soluble zwitterionic betaine surfactant, a Laponite clay thickener, an abrasive and water.

The instant thickened compositions having a G' of 20 to 500 Pascals over a temperature range of 4° C. to 50° C., a G" value of 25 to 600 Pascals over a temperature range of 4° C. to 50° C. and a complex viscosity at 25° C. of at least about 8.5, more preferably at least about 9.0 Pascal seconds and has a storage modules equal to higher than one Pascal (1 Newton/sq. m), more preferably higher than 5 Pascal at a temperature of 20° C. to 40° C. at a strain of 0.1% to 5% at a frequency of 10 radians per second as measured on a Carri-Med CS Rheometer and is thermally stable and exists as a liquid crystal in the temperature range from 10° C. to 45° C., more preferably 4° C. to 43° C. comprises approximately by weight:

(a) 20% to 40% of sodium $C_{13}$–$C_{17}$ paraffin sulfonate;

(b) 5% to 15% of a sodium or ammonium salt of ethoxylated $C_8$–$C_{16}$ alkyl ether sulfate;

(c) 0 to 10% of a perfume, water insoluble hydrocarbon or essentially oil;

(d) 0 to 10% of a zwitterionic;

(e) 0 to 20% of an abrasive;

(f) 0 to 10% of magnesium sulfate;

(g) 0.25% to 2.0% of a Laponite clay; and (h) the balance being water, wherein the composition does not contain any cosurfactant containing an ether linkage.

DETAILED DESCRIPTION OF THE INVENTION

The anionic surfactant, which is an essential ingredient of present liquid cleaning composition, constitutes about 25 to 55, preferably 30 to 50 by weight thereof and are water soluble such as triethanolamine and include the sodium, potassium, ammonium and ethanolammonium salts of $C_8$–$C_{18}$ alkyl sulfates such as lauryl sulfate, myristyl sulfate and the like; linear $C_8$–$C_{16}$ alkyl benzene sulfonates; $C_{10}$–$C_{20}$ paraffin sulfonates; alpha olefin sulfonates containing about 10–24 carbon atoms; $C_8$–$C_{18}$ alkyl sulfoacetates; $C_8$–$C_{18}$ alkyl sulfosuccinate esters; $C_8$–$C_{18}$ acyl isethionates; and $C_8$–$C_{18}$ acyl taurates. Preferred anionic surfactants are the water soluble $C_{12}C_{16}$ alkyl sulfates, the $C_{10}$–$C_{15}$ alkylbenzene sulfonates, the $C_{13}$–$C_{17}$ paraffin sulfonates and the $C_8$–$C_{16}$ ethoxylated alkyl ether sulfates and mixtures thereof.

The water-soluble zwitterionic surfactant, which is optionally used in the liquid cleaning composition, constitutes about 0 to 10%, more preferably 1% to 6%, by weight and provides good foaming properties and mildness to the present nonionic based liquid detergent. The zwitterionic surfactant is a water soluble betaine having the general formula:

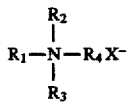

wherein $X^-$ is selected from the group consisting of $CO_2^-$ and $SO_3^-$ and $R_1$ is an alkyl group having 10 to about 20 carbon atoms, preferably 12 to 16 carbon atoms, or the amido radical:

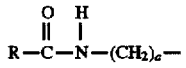

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N, N-dimethyl-ammonia) acetate, coco dimethyl betaine or 2-(N-coco N, N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine. Two preferred betaine surfactants are Rewoteric AMB 13 and Golmschmidt Betaine L7.

According to the present invention, the role of the water insoluble hydrocarbon may be provided by a non-water-soluble perfume. Typically, in aqueous based compositions the presence of a solubilizers, such as alkali metal lower alkyl aryl sulfonate hydrotrope, triethanolamine, urea, etc., is required for perfume dissolution, especially at perfume levels of 1% and higher, since perfumes are generally a mixture of fragrant essential oils and aromatic compounds which are generally not water-soluble.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

Quite surprisingly although the perfume is not, per se, a solvent for greasy or oily soil,—even though some perfumes may, in fact, contain as much as 80% of terpenes which are known as good grease solvents—the inventive compositions in dilute form have the capacity to solubilize up to 10 times or more of the weight of the perfume of oily and greasy soil, which is removed or loosened from the hard surface by virtue of the action of the anionic and nonionic surfactants, said soil being taken up into the oil phase of the o/w microemulsion.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the cleaning composition in an amount of from 0 to 10% by weight, preferably from 0.2% to 8% by weight.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

Thus, merely as a practical matter, based on economic consideration, the liquid crystal cleaning compositions of the present invention may often include as much as 0.2% to 7% by weight, based on the total composition, of terpene solvents introduced thereunto via the perfume component. However, even when the amount of terpene solvent in the cleaning formulation is less than 1.5% by weight, such as up to 0.6% by weight or 0.4% by weight or less, satisfactory grease removal and oil removal capacity is provided by the inventive compositions.

In place of the perfume in the cleaning composition at the same previously defined concentrations that the perfume was used in the cleaning composition one can employ an essential oil or a water insoluble organic compound such as a water insoluble hydrocarbon having 6 to 18 carbon such as a paraffin or isoparaffin such as d-limonene, isoparH, isodecane, alpha-pinene, beta-pinene, decanol and terpineol.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanillin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanillin, Vetyver oil (Java), Wintergreen The instant cleaning compositions contain about 0 to 20 wt. %, more preferably 0.5 to 10 wt. % of an abrasive selected from the group consisting of amorphous hydrated silica, calcite which is a limestone calcium carbonate, and polyethylene powder particles and mixtures thereof.

The used amorphous silica (oral grade) to enhance the scouring ability of the liquid crystal gel was provided by Zeoffin. The mean particle size of Zeoffin silica is 8 up to 10 mm. Its apparent density is 0.32 to 0.37 g/ml.

Another silica is Tixosil 103 made by Rhone-Poulenc. An amorphous hydrated silica from Crosfield of different particles sizes (9, 15 and 300 mm), and same apparent density was also used.

The polyethylene powder used in the instant invention has a particle size of about 200 to about 500 microns and a density of about 0.91 to about 0.99 g/liter, more preferably about 0.94 to about 0.96.

Another preferred abrasive is calcite used at a concentration of about 0 to 20 wt. %, more preferably 1 wt. % to 10 wt. % and is manufactured by J. M. Huber Corporation of Illinois. Calcite is a limestone consisting primarily of calcium carbonate and 1% to 5% of magnesium carbonate which has a mean particle size of 5 microns and oil absorption (rubout) of about 10 and a hardness of about 3.0 Mohs.

The Laponite clay used in the instant composition at a concentration of about 0.25 to 2.0 wt. %, more preferably 0.5 to 1.75 wt. % is a synthetic colored clay optionally having at least 5.0 wt. % of tetrapotassium pyrrophosphate peptizer which is Laponite RDS. The particle size of Laponite RDS which is manufactured by Laponite Inorganics of Great Britain has a particle size of <2% greater than 250 microns a bulk density of about 1000 $Kg/m^3$, and a surface area of about 330 $m^3/g$. Laponite RD does not have a peptizer and has a particle size of <2% greater than 250 microns, a surface area of about 370 $m^2/g$ and a bulk density of about 1000 $Kg/m^3$.

In addition to their excellent scouring ability and capacity for cleaning greasy and oily soils, cleaning compositions also exhibit excellent cleaning performance and removal of soap scum and lime scale in neat (undiluted) as well as in diluted usage.

The instant compositions contains about 0 to about 10 wt. %, more preferably about 2 to about 8 wt. % of an alkali metal carbonate such as sodium carbonate or potassium carbonate and mixtures thereof.

In addition to their excellent scouring ability and capacity for cleaning greasy and oily soils, the cleaning compositions also exhibit excellent cleaning performance and removal of soap scum and lime scale in neat (undiluted) as well as in diluted usage.

The instant composition can contain about 0 to about 10 wt. %, more preferably about 1 to about 8 wt. % of a magnesium salt such as magnesium chloride and/or magnesium sulfate heptahydrate and mixtures thereof.

The final essential ingredient in the inventive microemulsion compositions having improved interfacial tension properties is water. The proportion of water in the liquid crystal detergent composition generally is in the range of 20% to 97%, preferably 70% to 97% by weight.

In addition to the previously mentioned essential and optional constituents of the thickened cleaning composition, one may also employ normal and conventional adjuvants, provided they do not adversely affect the properties of the detergent. Thus, there may be used various coloring agents and perfumes; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be about 0.1 to 5% by weight and preferably less than about 2% by weight. Sodium bisulfite can be used as a color stabilizer at a concentration of about 0.01 to 0.2 wt. %. Typical perservatives are dibromodicyano-butane, citric acid, benzylic alcohol and poly (hexamethylene-biguamide) hydrochloride and mixtures thereof.

The instant compositions can contain about 0 to about 4 wt. percent, more preferably 0.1 to 3 wt. percent of an alkyl polysaccharide surfactant. The alkyl polysaccharides surfactants, which are used in conjunction with the aforementioned surfactant have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the 1-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG25 is a nonionic alkyl polyglycoside characterized by the formula:

$$C_nH_{2n+1}O(C_6H_{10}O_5)_xH$$

wherein n=10 (2%); n=122 (65%); n=14 (21–28%); n=16 (4–8%) and n=18 (0.5%) and x (degree of polymerization) =1.6. APG 625 has: a pH of 6 to 10 (10% of APG 625 in distilled water); a specific gravity at 25° C. of 1.1 g/ml; a density at 25° C. of 9.1 lbs/gallon; a calculated HLB of 12.1 and a Brookfield viscosity at 35° C., 21 spindle, 5–10 RPM of 3,000 to 7,000 cps.

The present thickened liquid cleaning compositions such as dishwashing liquids are readily made by simple mixing methods from readily available components which, on storage, do not adversely affect the entire composition. The use of mild heating (up to 100° C.) assists in the solubilization of the surfactants. No clay or polymeric thickening agent is added. In all such cases the product made will be pourable from a relatively narrow mouth bottle (1.5 cm. diameter) or opening, and the viscosity of the detergent formulation will not be so low as to be like water. The pH of the cleaning composition is substantially neutral to skin, e.g., about 4.5 to 8 and preferably about 5.5.

The instant compositions having a minimum foam height at 55 rotations at 40° C. of at least 150 ml, more preferably at least 160 ml. The test solution was 0.75 grams of LDL liter of water and 10 g/l of corn oil per liter of water having a hardness of 300 PPM.

The following examples which are made by the previously described simple mixing procedure are set forth to define the limits of the two preferred compositions of the instant invention.

EXAMPLE 1

The following formulas were made by simple mixing at 25° C.

| Raw Material | A % | B % | C % |
|---|---|---|---|
| PS | 25.5 | 25.5 | 24 |
| AEOS | 8.5 | 8.5 | 6 |
| Laponite RDS | 1.5 | 1.5 | 0.75 |
| d-Limonene | 6 | 6 | — |
| CAPB | — | — | 5 |
| $MgSO_4.7H_2O$ | — | — | 5 |
| Calcite | — | 5 | 8 |
| Miniplate | 51 | 51 | 42 |
| Gardner Neat | Better | Better | Much Better |
| Heavy grease soil | Much Better | Much Better | Equal |

1. Miniplate test

Miniplate test aims at assessing foam satability/duration of a dish liquid solution (1.25 g/l) in presence f a fat (Crisco Vegetal shortening ex P&G). The higher the number the better the product.

2. Gardner neat on baked on soils

This test aims at assessing the cleaning power of a dish product on a mixed baked on soil. Soil is made of egg yolk, margarin, beef extract and instant flour spread with a brush on a tile and put in an oven at 270° C. for 10 minutes the test uses a gardner washability machine and measures the number of strokes needed to clean the surface of a tile made of formica. In each experiment a reference (premium competitive product) is included and results are given in comparison to this reference.

3. Heavy greasy soil.

This test aims at assessing the auto active power (capacity to quickly aborb oil under static conditions) of a dish liquid on a heavy greasy soil (hydrogenated beef tallow) the results are always given in comparison to a reference (premium competitive product)

What is claimed is:

1. A thickened aqueous liquid cleaning composition consisting essentially of approximately, by weight:

(a) 5% to 15% of a water soluble alkali metal or ammonium salt of a $C_8$–$C_{16}$ ethoxylated alkali ether sulfate;

(b) 20% to 40% of a water-soluble alkali metal salt of a $C_{10}$–$C_{20}$ paraffin sulfonate;

(c) 1% to 6% of a water-soluble betaine;

(d) 0 to 10% of a magnesium sulfate;

(e) 0.5% to 10 wt. % of an abrasive;

(f) 0.25% to 2.0% of a Laponite clay thickener having a particle size of <2% greater than 250 microns;

(g) 0.2% to 8% of a perfume, water insoluble hydrocarbon or essential oil; and (h) the balance being water, said composition having a pH of about 5.5.

2. A composition according to claim 1, wherein said abrasive is calcite.

3. The composition of claim 1 wherein the concentration of said abrasive is 0.5 wt. % to 10 wt. %.

4. The composition of claim 3 wherein said abrasive is selected from the group consisting of amorphous hydrated silica, calcite and polyethylene powder particles and mixtures thereof.

5. The composition of claim 1 wherein the concentration of said betaine is 1 wt. % to 6 wt %.

6. The composition of claim 1 wherein the concentration of the magnesium sulfate is 1 wt. % to 8 wt. %.

7. The composition of claim 4 wherein the concentration of said perfume, water insoluble hydrocarbon or essential oil is 0.2 wt. % to 8 wt. %.

8. The composition of claim 6 wherein said hydrocarbon is d-limonene.

9. The composition of claim 1 wherein said clay thickener includes a peptizer.

* * * * *